US005839128A

United States Patent [19]

Wang

[11] Patent Number: 5,839,128

[45] Date of Patent: Nov. 24, 1998

[54] ANTISEPTIC SOLUTION DISPENSER

[76] Inventor: Ming-Wen Wang, 1F, No. 35, Da-Noan Road, Tu-Chen City, Taipei Hsien, Taiwan

[21] Appl. No.: 863,503

[22] Filed: Jun. 2, 1997

Related U.S. Application Data

[63] Continuation-in-part of Ser. No. 514,702, Aug. 14, 1995.

[51] Int. Cl.[6] ..... E03D 9/02

[52] U.S. Cl. ..... 4/227.2

[58] Field of Search ..... 4/225.1, 226.1, 4/227.1, 227.2, 227.3, 227.4

[56] References Cited

U.S. PATENT DOCUMENTS 3,766,570 10/1973 Finneran ..... 4/227.3 X
3,778,850 12/1973 Bryan ..... 4/227.3
4,346,483 8/1982 Rosen et al. ..... 4/227.3
4,915,260 4/1990 Jones ..... 4/227.2
4,949,403 8/1990 LoMaglio ..... 4/227.3

*Primary Examiner*—Charles E. Phillips
*Attorney, Agent, or Firm*—Bucknam and Archer

[57] ABSTRACT

An antiseptic solution dispenser installed in the tank of a toilet to dispense an antiseptic solution, including a container to hold an antiseptic solution, the container having a clip for fastening to the overflow tube of the tank of the toilet, and a storage float coupled to the bottom coupling neck of the container after the removal of a tear tape on the outside flange of the half-round barrel of the storage float. As the tank of the toilet is filled up with water, the half-round barrel is moved upwards by the rising water, causing the antiseptic solution to flow out of dispensing holes on the half-round barrel, and as water is drawn away from the tank of the toilet, the half-round barrel is lowered and a metered amount of the antiseptic solution is transferred out of the container into the half-round barrel of the storage float.

7 Claims, 4 Drawing Sheets

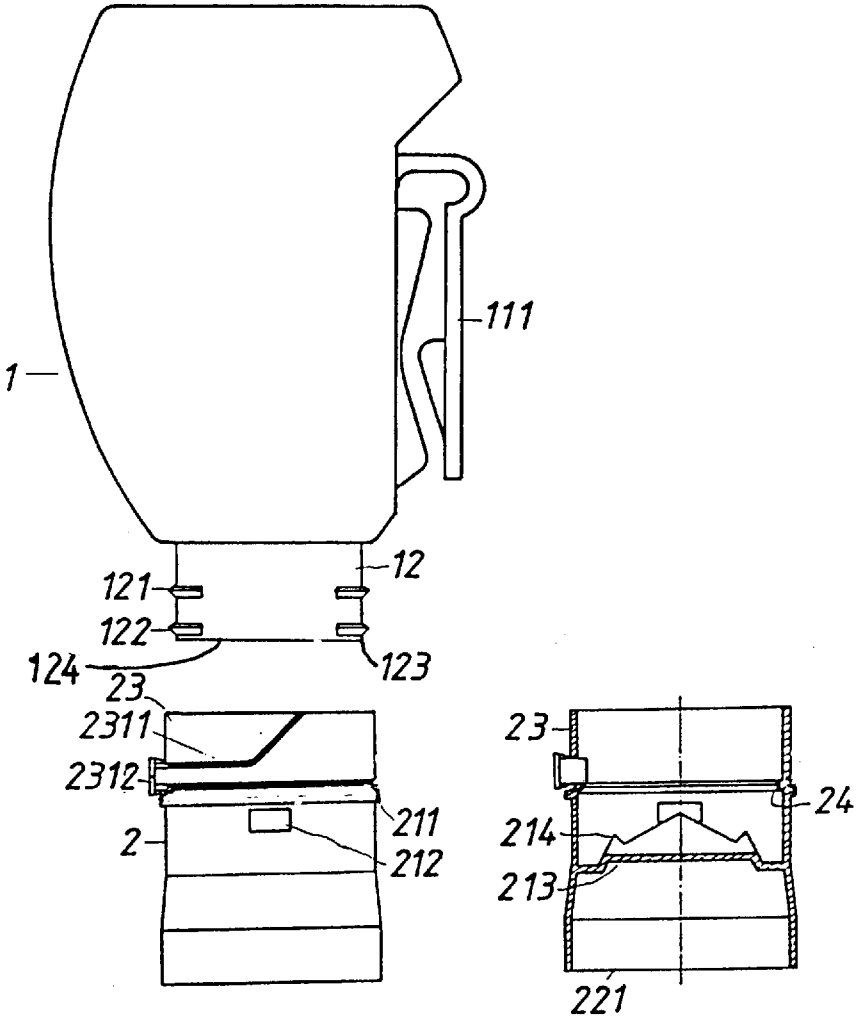
FIG. 4
FIG. 5
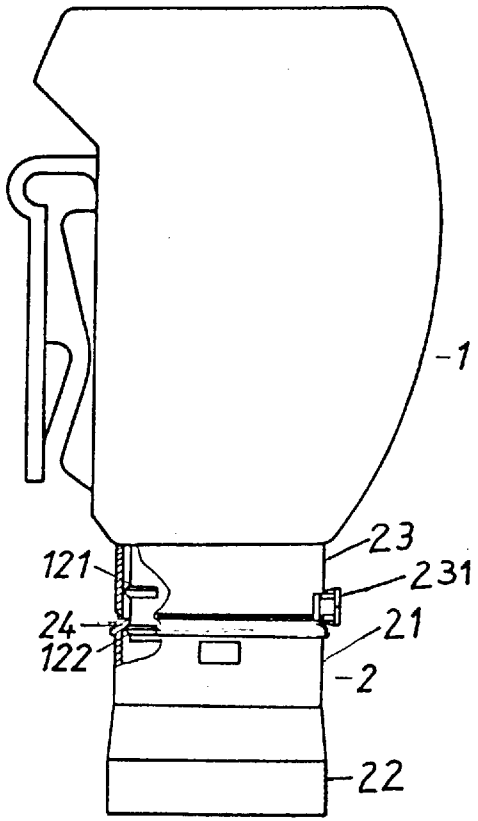
FIG. 3

ANTISEPTIC SOLUTION DISPENSER

CROSS REFERENCE TO RELATED APPLICATION

This application is a continuation-in-part of my earlier filed application, Ser. No. 08/514,702, filed Aug. 14, 1995.

BACKGROUND OF THE INVENTION

The present invention relates to an antiseptic solution dispenser which automatically dispenses a metered amount of an antiseptic solution into the tank of a toilet when the tank is filled with water after each flushing operation.

The flush piping systems of toilets must be regularly sterilized in order to prevent the growth of bacteria and germs. In order to sterilize the flush piping system of a toilet, the tendency is to directly pour a prepared antiseptic solution into the tank of the toilet. However, the antiseptic solution is soon used up if it is completely poured into the water. Therefore, the antiseptic solution must be frequently refreshed.

SUMMARY OF THE INVENTION

It is the main object of the present invention to provide an antiseptic solution dispenser which automatically provides a metered amount of an antiseptic solution for mixing with the water in the tank of toilets after every flushing operation. According to the preferred embodiment of the present invention, the antiseptic solution dispenser comprises a container holding an antiseptic solution, the container having a clip for fastening to the overflow tube of the tank of the toilet, and a storage float coupled via a half-round barrel to the bottom coupling neck of the container. As the tank of the toilet is filled up with water, the half-round barrel is moved upwards on the coupling neck by the rising water, causing the antiseptic solution to flow out of dispensing holes on the sides of the half-round barrel. When water is removed from the tank of the toilet during the flushing operation, the half-round barrel is lowered on the coupling neck, and a metered amount of the antiseptic solution flows out of the container into the half-round barrel of the storage float. For storage purposes, a tear tape is attached to an outside flange of the half-round barrel to prevent its movement on the coupling neck of the container.

BRIEF DESCRIPTION OF THE DRAWINGS

FIG. 3 is a view similar to that of FIG. 2 wherein the antiseptic solution dispenser is shown partially in cross-section;

FIG. 4 is a right side elevational view of the antiseptic solution dispenser shown in FIG. 1, showing the container and the storage float disconnected;

FIG. 5 is a cross-sectional view of the storage float shown in FIG. 4;

DETAILED DESCRIPTION OF THE PREFERRED EMBODIMENT

Figure 2:
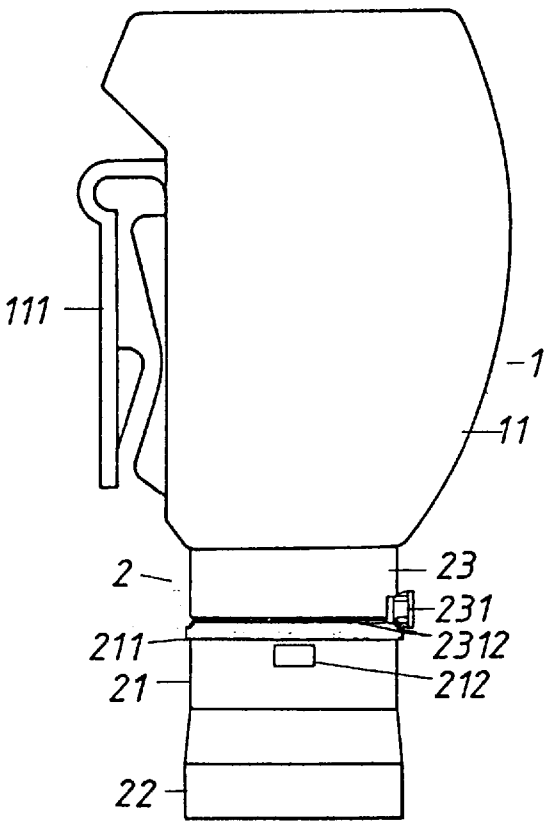
FIG. 2 is a left side elevational view of the antiseptic solution dispenser shown in FIG. 1.
Figure 1:
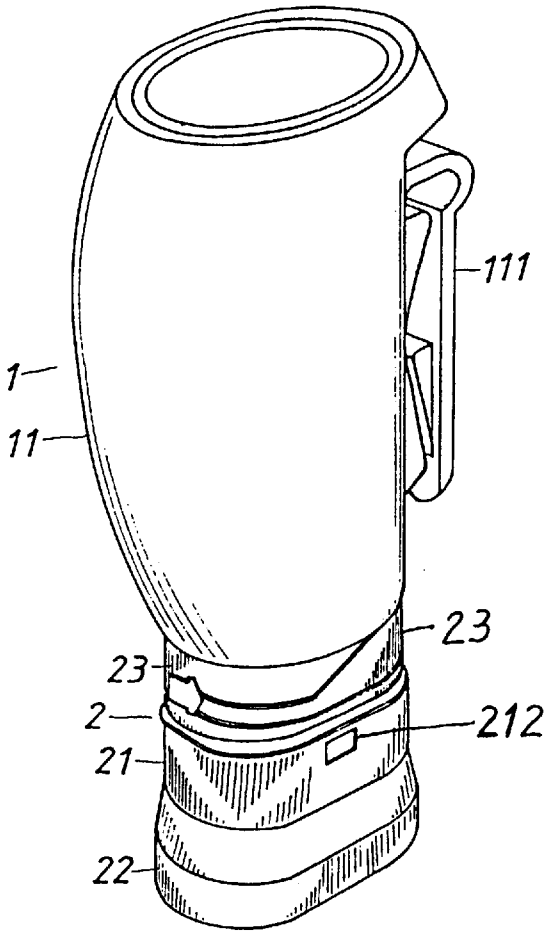
FIG. 1 is a perspective elevational view of the antiseptic solution dispenser according to the present invention.

Now turning to the drawings, there is shown in FIGS. 1 and 2 an antiseptic solution dispenser comprising a container, designated 1, and a storage float, designated 2.

As clearly seen in FIG. 4, container 1 includes an oval container body 11 having a downward clip 111 extending from the rear side of container body 11, and a coupling neck 12 extending from the bottom of container body 11. Coupling neck 12 has a plurality of upper locating flanges 121 extending outwardly therefrom and a plurality of lower locating flanges 122, spaced from flanges 121, extending outwardly therefrom. At the bottom of coupling neck 12 is an opening 123 sealed by a foil seal 124.

Figure 6:
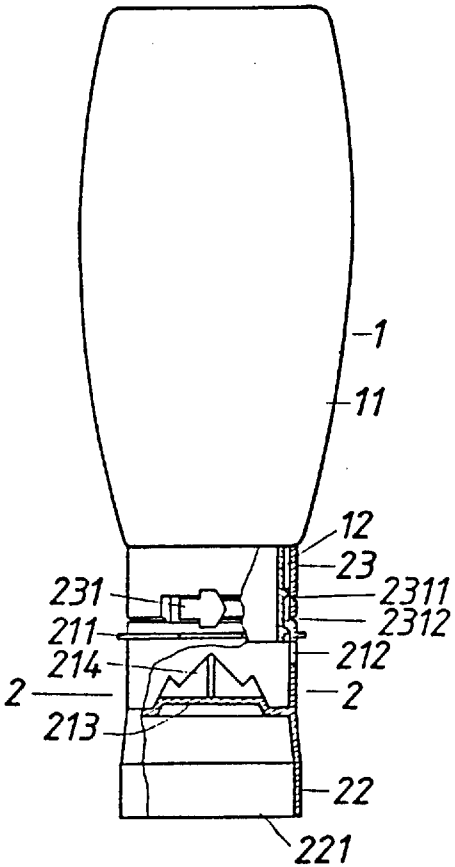
FIG. 6 is a front elevational view partially in cross-section of the antiseptic solution dispenser shown in FIG. 1.

Storage float 2 includes a half-round barrel 21 and a float 22 connected to the bottom side of half-round barrel 21. As clearly seen in FIG. 5, half-round barrel 21 includes an outside flange 211 to which is connected tear tape 23, two oppositely disposed dispensing openings 212, a closed bottom wall 213, and a pointed projecting block 214 raised from bottom wall 213. Flanges 24, projecting inwardly at the upper end of half-round barrel 21, connects storage float 2 to coupling neck 12 by engagement with lower locating flanges 122 of coupling neck 12, as seen in FIG. 3. Also as seen in FIGS. 3, 4 and 6, tear tape 23, connected to flanges 211 of half-round barrel 21, serves to prevent upward movement of storage float 2 relative to coupling neck 12 of container 1 until the tear tape is removed by grasping the arrow-like tip 231 and pulling the same to cause separation of the upper split line 2311 and the lower split line 2312. By the removal of tear tape 23, half-round barrel 21 of storage float 2 is free to move axially upwardly on coupling neck 12 as hereinafter described.

Figure 7:
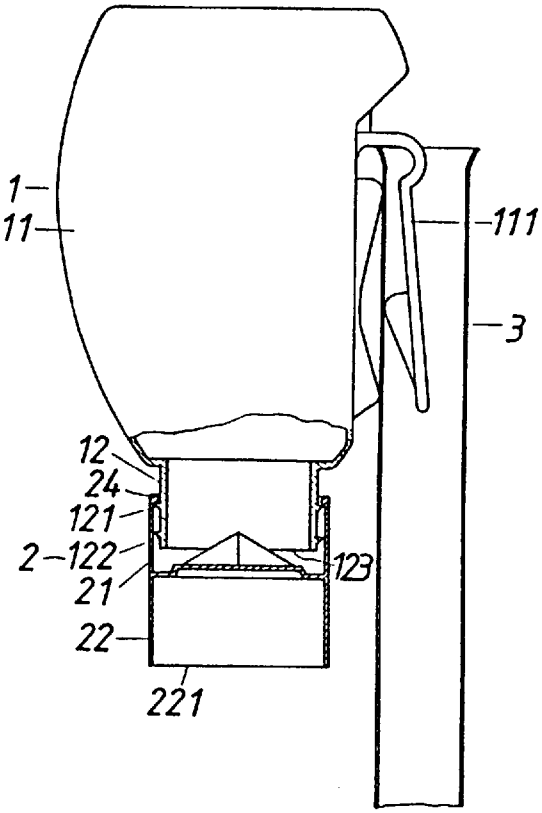
FIG. 7 is an elevational view of the antiseptic solution dispenser of the present invention installed.

As clearly seen in FIG. 7, the antiseptic solution dispenser is installed for use in a toilet by fastening downward clip 111 of container body 11 to the overflow tube 3 in the storage tank of a flush toilet subsequent to removal of tear tape 23.

Figure 9:
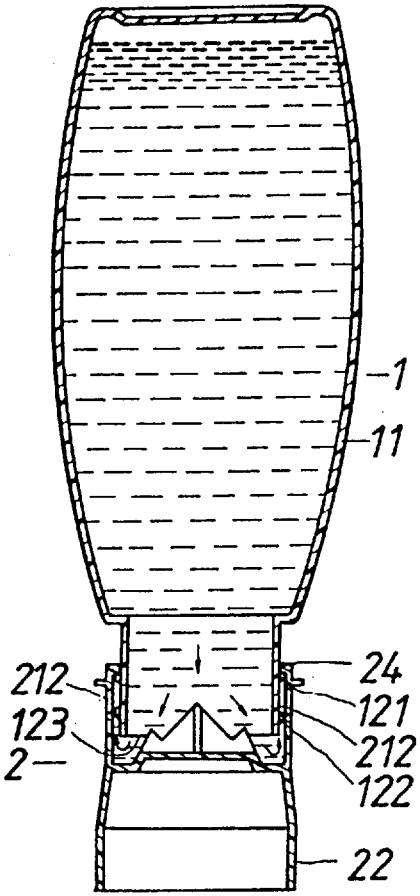
Figure 8:
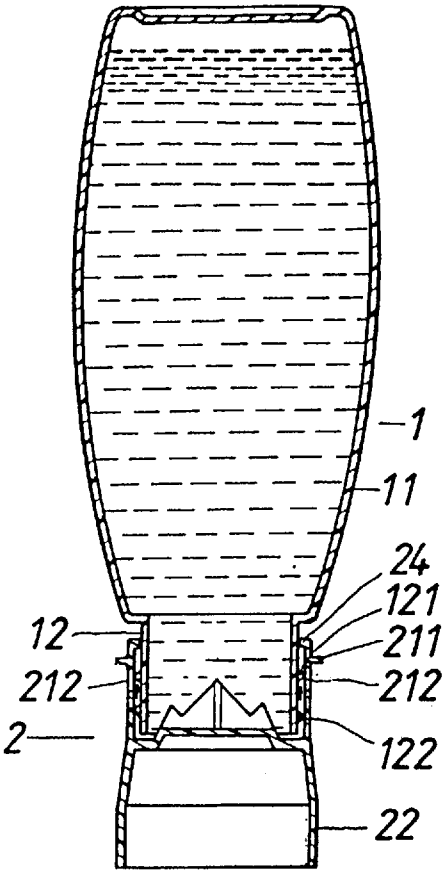

In operating the antiseptic solution dispenser subsequent to installation, the user pushes upwardly on storage float 2 so as to cause pointed projecting block 214 to break foil seal 124 and force inwardly projecting flanges 24 of half-round barrel 21 over upper locating flanges 121 of coupling neck 12, as clearly seen in FIG. 8. As clearly seen in FIG. 9, upon release of storage float 2 by the user, the storage float moves downwardly on coupling neck 12 until inwardly projecting flanges 24 of half-round barrel 21 contact upper locating flanges 121 of coupling neck 12 which prevent the further dowward movement of storage float 2. Simultaneously, liquid antiseptic solution contained in container body 11 flows out of now unsealed opening 123 into half-round barrel 21 until opening 123 is completely covered by the solution contained in half-round barrel 21. Because of the vacuum created in container body 11 by the transfer of solution to half-round barrel 21 no additional solution flows into the half-round barrel once opening 123 of container body 11 is covered by the level of antiseptic solution in half-round barrel 21.

Figure 10:
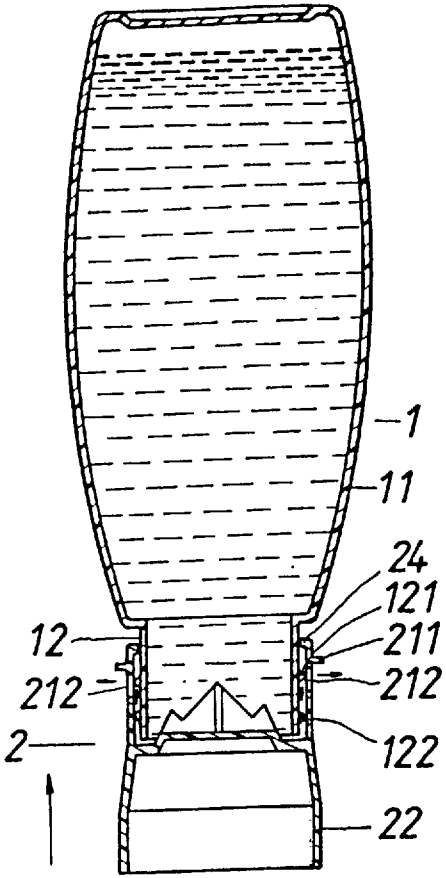
FIGS. 8–10 are cross-sectional elevational views of the antiseptic solution dispenser showing the sequence of operation thereof.

As the water in the storage tank of the flush toilet rises, it causes float 22 of storage float 2 to rise and expel the antiseptic solution contained in half-round barrel 21 out of openings 212 therein, as clearly seen in FIG. 10. The antiseptic solution thus expelled mixes with the water in the storage tank and disinfects the same. During the flushing operation as the water is removed from the storage tank, storage float 2 moves downwardly on coupling neck 12 allowing a metered amount of antiseptic solution to flow into half-round barrel 21, as described above.

While only a single embodiment of the present invention has been shown and described, it will be understood that various modifications and changes can be made thereto without departing from the spirit and scope of the present invention.

What is claimed is:

1. An antiseptic solution dispenser installed in the tank of a toilet to dispense an antiseptic solution, comprising:

a container to hold an antiseptic solution, said container comprising an oval container body and a coupling neck extended from said container body, said coupling neck having a plurality of upper locating flanges and lower locating flanges raised from an outside wall thereof at different elevations and a bottom opening; and a storage float coupled to said coupling neck of said container, said storage float comprising a half-round barrel and a float connected to a bottom side of said half-round barrel, said half-round barrel including two dispensing openings and an inside flange raised from an inside wall thereof, said inside flange of said half-round barrel cooperating with the locating flanges of said coupling neck so that prior to operation of said dispenser said inside flange cooperates with said lower locating flanges to retain said storage float on said coupling neck and during operation said inside flange cooperates with said upper locating flanges to permit upward and downward movement of said storage float on said coupling neck between said upper locating flanges and said container body;

whereby, as the tank of the toilet is filled with water, the half-round barrel is moved upwards by the rising water, causing the antiseptic solution contained therein to flow out of said half-round barrel through said dispensing openings and as water is drawn away from the tank of the toilet, the half-round barrel is lowered and a metered amount of antiseptic solution flows out of said container body through the bottom opening of said coupling neck into said half-round barrel, the vacuum resulting in the container body from the transfer of antiseptic solution therefrom causes the transfer to cease when the bottom opening of said coupling neck is covered by the level of antiseptic solution in said half-round barrel.

2. The antiseptic solution dispenser defined in claim 1, wherein the bottom opening of said coupling neck is sealed by a foil seal.

3. The antiseptic solution dispenser as defined in claim 2, wherein said storage float further includes a tear tape connected to an outside flange at a top end of said half-round barrel, said tear tape comprising an arrow-like tip at a front side, and two split lines at different elevations, said tear tape being separable from said outside flange of said half-round barrel for allowing said half-round barrel to be moved vertically along said coupling neck to receive a metered amount of the antiseptic solution from said container or to dispense the received amount of the antiseptic solution through said dispensing openings.

4. The antiseptic solution dispenser as defined in claim 3, wherein said inside flange of said half-round barrel is moved over the locating flanges of said coupling neck and stopped above the upper locating flanges of said coupling neck after the removal of said tear tape, permitting said half-round barrel to be moved vertically along said coupling neck to receive a metered amount of the antiseptic solution from said container or to dispense the received amount of the antiseptic solution through said dispensing holes.

5. The antiseptic solution dispenser as defined in claim 2, wherein said half-round barrel has a pointed projecting block raised from a closed bottom wall thereof for piercing said foil seal to let the antiseptic solution flow out of said container into said half-round barrel.

6. The antiseptic solution dispenser as defined in claim 1, wherein the float of said storage float has an opening at a bottom side thereof.

7. The antiseptic solution dispenser as defined in claim 1, wherein said container body has a downward clip at a back side thereof for fastening to an overflow tube of the tank of the toilet.

* * * * *